US011873154B1

(12) United States Patent
Moorehead et al.

(10) Patent No.: US 11,873,154 B1
(45) Date of Patent: Jan. 16, 2024

(54) CONTACT LENS PACKAGING AND METHODS

(71) Applicant: Bausch + Lomb Ireland Limited, Dublin (IE)

(72) Inventors: Michael Moorehead, Fairport, NY (US); Kevin Schaffer, Pittsford, NY (US); William J. Seyboth, Rochester, NY (US); Baxter J. Lansing, Ontario, NY (US)

(73) Assignee: Bausch + Lomb Ireland Limited, Dublin (IE)

( * ) Notice: Subject to any disclaimer, the term of this patent is extended or adjusted under 35 U.S.C. 154(b) by 0 days.

(21) Appl. No.: 18/064,507

(22) Filed: Dec. 12, 2022

(51) Int. Cl.
*B65D 81/22* (2006.01)
*B65D 85/00* (2006.01)
*B65D 75/36* (2006.01)

(52) U.S. Cl.
CPC ..... *B65D 81/22* (2013.01); *B65D 75/366* (2013.01); *B65D 85/54* (2013.01); *B65D 2585/545* (2013.01)

(58) Field of Classification Search
CPC ..... B65D 81/22; B65D 75/366; B65D 85/54; B65D 2585/545
USPC ..... 206/5.1
See application file for complete search history.

(56) References Cited

U.S. PATENT DOCUMENTS 5,620,087 A 4/1997 Martin et al.
5,711,416 A * 1/1998 Bauman ..... B65D 75/52 206/210
6,044,966 A * 4/2000 Haase ..... B65D 77/2024 206/5.1
7,086,526 B2 8/2006 Newman
7,398,877 B1 * 7/2008 Nelson ..... A45C 11/005 206/5
8,881,892 B1 * 11/2014 Linhardt ..... B65D 25/08 600/319
9,439,487 B2 9/2016 Barre et al.
9,615,639 B2 4/2017 Newman
9,723,903 B2 8/2017 Barre et al.
10,092,075 B2 10/2018 Barre et al.
10,368,621 B2 8/2019 Barre et al.
(Continued)

FOREIGN PATENT DOCUMENTS

EP 0765741 A2 4/1997
WO 2014150906 A1 9/2014
WO 2022/054031 A2 3/2022

*Primary Examiner* — Jacob K Ackun
(74) *Attorney, Agent, or Firm* — Simpson & Simpson, PLLC

(57) ABSTRACT

A contact lens package, comprising blister packaging defining a cavity, a contact lens disposed in an unstressed state within the cavity, lens hydrating liquid partially filling the cavity, and lid stock sealed to the blister packaging such that a segment of the lid stock, in combination with the cavity, forms an enclosure of the lens and the liquid. The segment has an interior surface including at least one relief element. The interior surface exclusive of the at least one relief element is flat. An air gap is disposed between a top surface of the liquid and at least a portion of the interior surface. The at least one relief element on the interior surface of the lid stock may be formed while testing the structure for leaks by applying pressure to the lid stock with a stamp having a contour corresponding to the at least one relief element.

18 Claims, 3 Drawing Sheets

(56) References Cited

U.S. PATENT DOCUMENTS

| | | | | |
|---|---|---|---|---|
| 2002/0046958 | A1* | 4/2002 | Lipscomb | A45C 11/005 206/5.1 |
| 2004/0238380 | A1* | 12/2004 | Newman | B65D 81/22 206/5.1 |
| 2006/0213784 | A1* | 9/2006 | Tokarski | B65D 81/22 206/5.1 |
| 2010/0259719 | A1 | 10/2010 | Sabeta | |
| 2012/0006695 | A1* | 1/2012 | Kawai | B65B 25/008 351/159.02 |
| 2014/0262844 | A1* | 9/2014 | Barre | B65D 85/00 206/5.1 |
| 2015/0014187 | A1* | 1/2015 | Gilman | B65D 81/22 206/5.1 |
| 2020/0229561 | A1* | 7/2020 | Almond | B65B 25/008 |
| 2020/0231351 | A1* | 7/2020 | Almond | B65D 75/326 |
| 2021/0394986 | A1* | 12/2021 | Ellis | B65D 75/326 |
| 2023/0045046 | A1* | 2/2023 | Moorehead | B65D 75/326 |
| 2023/0060534 | A1* | 3/2023 | Lansing | B65D 85/54 |

* cited by examiner

CONTACT LENS PACKAGING AND METHODS

FIELD

Apparatus and methods for packaging a contact lens.

BACKGROUND

Packaging, shipping, and storing of a contact lens involves maintaining a contact lens (also referred to herein simply as a lens) in a cavity of blister packaging.

Typically, a lens is initially placed in a cavity of empty blister packaging. After the lens is placed in the cavity, the packaging is transported to one or more stations where the lens and lens packaging are further processed (e.g., inspected, hydrated with saline or another suitable liquid, heat-sealed into the cavity using lid stock (e.g., a conventional multilayer packaging foil), labeled, leak tested, and sterilized (e.g., by autoclaving)).

During transport, a lens and packaging is typically subjected to forces during travel between stations on a conveyor where the lens and packaging encounter, for example, substantial acceleration and deceleration, movement around bends, inversion, vibration and/or movement between conveyors by pick-and-place machines.

Prior to heat-sealing, movement of blister packaging having a lens and hydrating liquid disposed in a cavity presents quality risks, as well as risks to packaging machinery. For example, travel may result in liquid landing on a surface of the packaging on which a heat seal is to be formed or liquid may exit the cavity onto the conveyor or onto machinery present at one or more of the stations.

Additional quality risks are associated with maintenance of a lens in packaging after the packaging process is compete. A lens may spend considerable time (months or years) in the packaging, during which a lens is stored by a manufacturer or vendor, shipped for retail sale and/or stored by a consumer after retail sale.

During shipping and storing, a lens may be maintained in various orientations within the packaging. When lens packaging is maintained in certain orientations (e.g., upside down—with the lid stock underneath the lens), interaction between the lens and the lid stock (e.g., lens adherence to the lid stock by suction-cupping) has been known to affect the lens optical characteristics, at least temporarily. In some instances, lens adherence may be exacerbated by forces applied on the lens by a bubble present in the cavity after addition of the hydrating liquid and heat sealing. FIG. 1 is a schematic illustration of an upside-down contact lens package 10 in which adherence of a lens 50 to a foil lid stock 30 is affected by forces applied on the lens by a bubble B present in the cavity C (also referred to as "a well") of blister packaging 15. Typically, a contact lens package 10 is placed in secondary packaging (e.g., a carton) for sale.

In U.S. Pat. No. 10,368,621 (hereinafter Barre), it was suggested that, in effort to limit the ability of a lens to fold within a lens package, the head space (i.e., air gap) between the top of the saline and the lid stock be reduced. To reduce the head space and the resulting bubble size, Barre teaches that the foil covering the packaging cavity be concave across the entire width of a cavity such that the foil projects into the cavity; Barre further teaches that an emboss pattern can be added to the concave foil to limit adherence of a lens to the foil. In a further effort to reduce head space and bubble size, Bane teaches that the saline level in the cavity is to be increased.

Ideally, packaging and the packaging process maximize in-process yield (e.g., as determined by seal inspection, leak detection) as well as lens performance (i.e., lens function when a lens is placed on a wearer's eye).

SUMMARY

According to aspects of the present invention, in a contact lens package having lid stock to seal a contact lens in a cavity of blister packaging, an interior surface of the lid stock includes at least one relief element and the interior surface of the lid stock, exclusive of the at least one relief element, is flat.

As described in greater detail below, the flat interior surface (exclusive of any relief element) enhances the performance of relief features in preventing or decreasing the likelihood of lens adherence/suction-cupping to lid stock that may arise with an embossed-concave lid stock. Effectiveness of the flat interior surface at reducing adherence allows for a reduced amount of liquid (e.g., saline) in the cavity; and concomitantly, less liquid, along with the flat interior surface (exclusive of any relief element) promotes formation of room between the top surface of the saline and at least some portion(s) of the interior surface of the lid stock (when the package is oriented right-side up).

As a result of the reduced saline fill volume and the presence of an air gap above the top surface of the liquid, the chance of interaction between the lid stock and the saline during the heat-sealing process is limited, and the room between at least some portions of the top surface of the saline and the top of the cavity limits the possibility of saline exiting the cavity prior to heat sealing; both reduce the likelihood of quality issues related to saline landing on a surface of the packaging on which a heat seal is to be formed, or on a conveyor or machinery used in the packaging process. Additionally, saline is less likely to exit the cavity when the package is opened by a user of the lens.

An aspect of the present invention is directed to a contact lens package, comprising blister packaging defining a cavity, a contact lens disposed in an unstressed state within the cavity, and lens hydrating liquid partially filling the cavity. Lid stock is sealed to the blister packaging such that a segment of the lid stock in combination with the cavity forms an enclosure of the lens and the lens hydrating liquid. The segment has an interior surface including at least one relief element; and the interior surface, exclusive of the at least one relief element, is flat. An air gap is disposed between a top surface of the lens hydrating liquid and at least a portion of the interior surface.

In some embodiments, the lens hydrating liquid fills at most 99% of the volume of the cavity.

The at least one relief element may comprise a periodic structure. The structure may be periodic along a line extending through a center of the segment.

The at least one relief element may comprise a non-periodic structure along a line extending through a center of the segment.

In some embodiments, the at least one relief element consists of a single relief element.

An external surface of the lid stock may be flat. The lid stock may comprise an innermost layer that is plastic resin.

Another aspect of the invention is directed to a contact lens package, comprising blister packaging defining a cavity, a contact lens disposed in an unstressed state within the cavity, and lens hydrating liquid partially filling the cavity. Lid stock is sealed to the blister packaging such that a segment of the lid stock, in combination with the cavity, forms an enclosure of the lens and the lens hydrating liquid. The segment has an interior surface including at least one dome-shaped relief element. The interior surface, exclusive of the at least one relief element, is flat.

In some embodiments, the lens hydrating liquid fills at most 99% of the volume of the cavity.

In some embodiments, the at least one relief element comprises a periodic structure. The structure may be periodic along a line extending through a center of the segment.

In some embodiments, the at least one relief element comprises a non-periodic structure along a line extending through a center of the segment.

Yet another aspect of the invention is directed to a method of manufacturing a contact lens package, comprising (1) producing a structure comprising blister packaging defining a cavity, a contact lens disposed in the cavity, lens hydrating liquid partially filling the cavity, and lid stock sealed to the blister packaging such that a segment of the lid stock, in combination with the cavity, forms an enclosure of the lens and the lens hydrating liquid; and (2) testing the structure for leaks by applying pressure to the lid stock with a stamp having a contour corresponding to at least one relief element, whereby the pressure forms the at least one relief element on an interior surface of the lid stock.

The term "relief element" as used herein refers to a feature formed on an interior surface of lid stock, the feature having a difference in height relative to immediate-surrounding portions of the lid stock, the feature shaped with transitions in height such that a contact lens enclosed in a cavity of blister packaging by the lid stock cannot or is less likely to continuously adhere (i.e., conform) to the lid stock across the relief element. It will be appreciated that the ability of a lens to conform to the lid stock across a relief element is determined at least in part by the modulus of elasticity of the lens material, the lens edge design (with thicker edges being less susceptible to conforming), and the thickness of the lens profile. A relief element can be in the form of an indentation or a protuberance.

The term "flat" as used herein means without any processing to impart a contour (e.g., no imparted depression that extends substantially the entire distance between opposing sides of a heat seal (i.e., no dimple)). It will be appreciated that lid stock (e.g., conventional multilayer packaging foil) without processing to add a contour thereto typically has localized deviations in its surface slope and a heat-sealing process may cause a localized contour proximate the heat seal; despite these deviations, the lid stock may be "flat" or "substantially flat" across a cavity of blister packaging. Flat lid stock is substantially level between opposing sides of the blister packaging to which the lid stock is adhered, exclusive of artifacts of the heat-sealing process proximate the opposing sides and any relief elements.

The term "unstressed state" refers to a state of a lens in which a lens is not compressed by opposing surfaces (e.g., opposing surfaces of a package) such that the lens is flattened by the opposing surfaces beyond the lens shape determined by gravity and a liquid in which the lens is immersed.

The term "dome-shaped" refers to a shape having a continuous curvature across an area. A dome-shaped surface forms a discontinuity where the dome-shaped surface meets a flat surface. For example, a dome shaped surface may be formed from a portion of a sphere, a spheroid, an ellipsoid or an ovoid.

The term "cavity" includes any concave portion of the blister packaging in which the contact lens is nominally located when the lens package is right side up (typically dome-shaped), but also any other rounded or angled portion of the blister packaging that is fluidly coupled the concave portion (e.g., see portion E in FIG. 1). The volume of a cavity is determined as the space enclosed by and below a plane extending between the surface(s) to which lid stock is to be attached.

These and other aspects of the present invention will become apparent upon a review of the following detailed description and the claims appended thereto.

BRIEF DESCRIPTION OF THE DRAWINGS

Illustrative, non-limiting embodiments of the present invention will be described by way of example with reference to the accompanying drawings, in which the same reference number is used to designate a same or similar component(s) in different figures, and in which.

DETAILED DESCRIPTION

Aspects of the invention will be further described with reference to the following specific examples. It is understood that these examples are given by way of illustration and are not meant to limit the claimed inventions.

Figure 1:
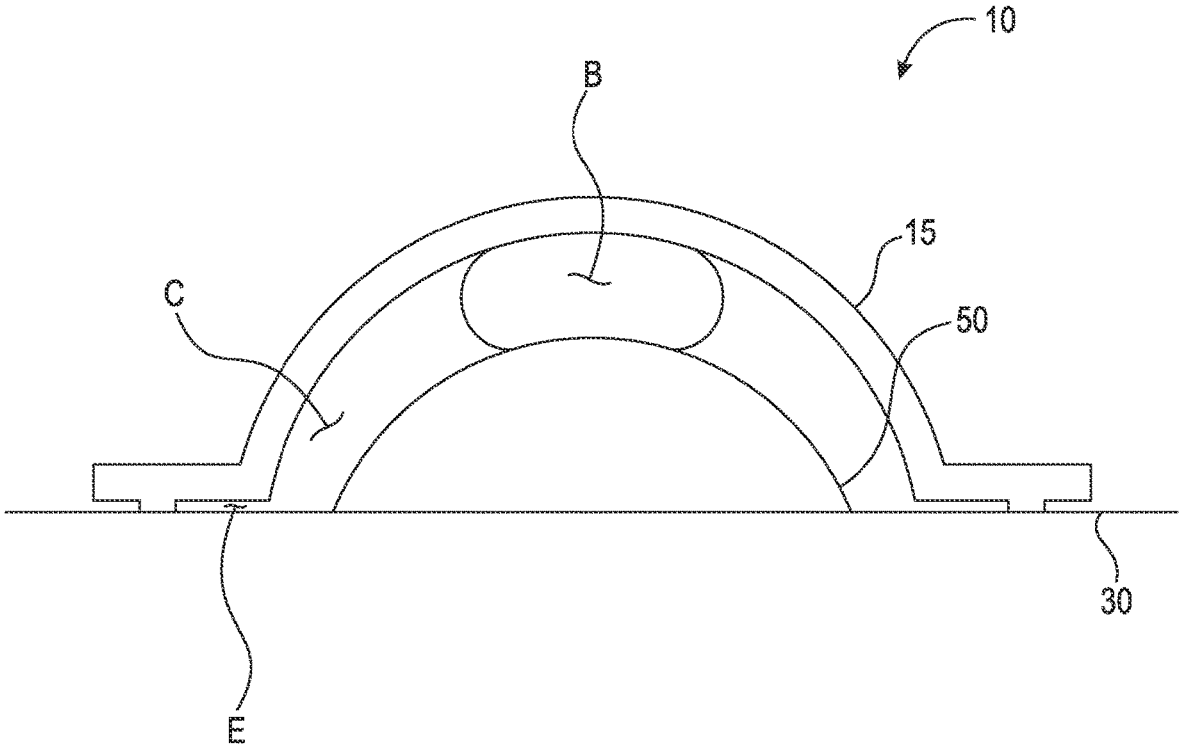
Fig. 1 PRIOR ART
FIG. 1, is a cutaway side schematic illustration of an inverted, conventional contact lens package, where adherence of a lens to lid stock is exacerbated by forces applied on the lens by a bubble present in the cavity.
Figure 2A:
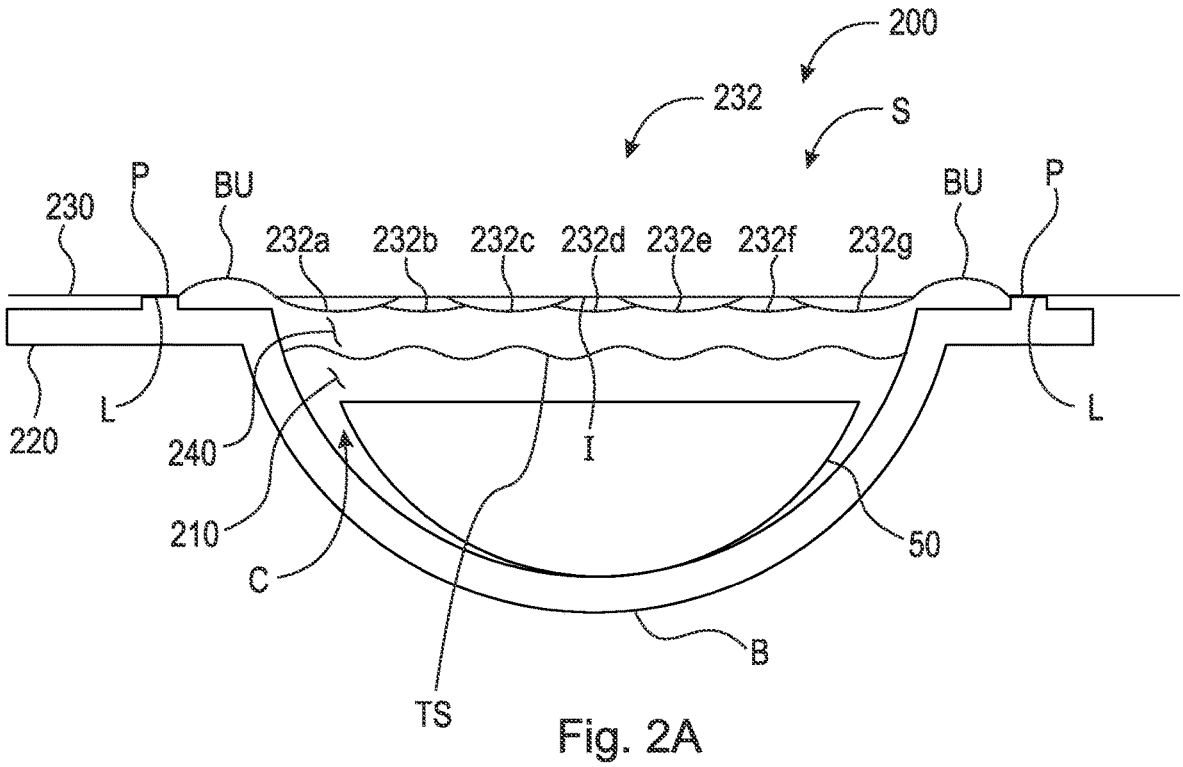
FIG. 2A is a cutaway side schematic illustration of an example of a contact lens package according to aspects of the present invention.
Figure 2B:
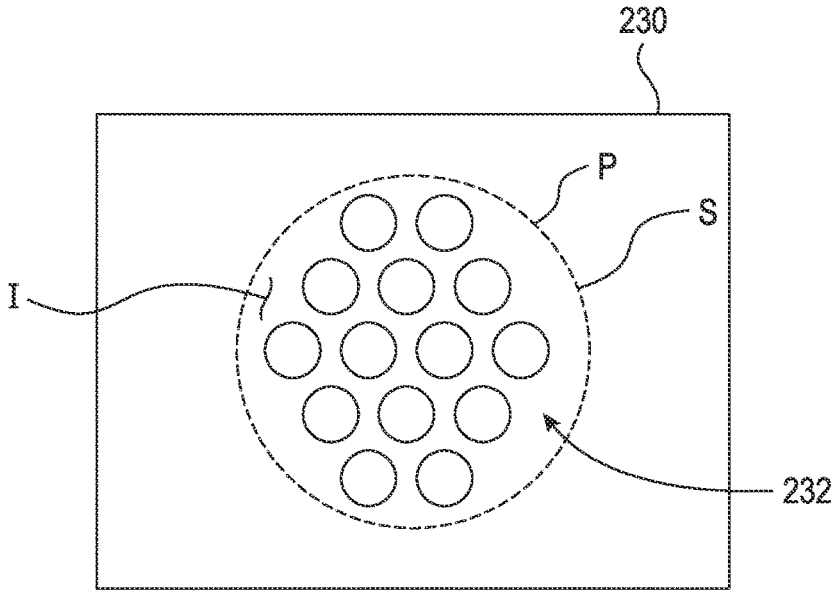
FIG. 2B is a schematic plan view of the interior side of lid stock of the lens package in FIG. 2A shown apart from the remainder of the package for ease of description.

FIG. 2A is a cutaway side schematic illustration of an example of a contact lens package 200 according to aspects of the present invention. FIG. 2B is a schematic plan view illustration of a lid stock 230 of lens package 200. Contact lens package 200 comprises blister packaging 220 which defines a cavity C. Contact lens 50 is disposed in cavity C in an unstressed state, and a lens hydrating liquid 210 partially fills cavity C. Cavity C has a spheroid shaped portion in which contact lens 50 is located.

Lid stock 230 is sealed to blister packaging 220 at a landing L about a perimeter P such that a segment S of the lid stock in combination with the cavity C forms an enclosure of lens 50 and the lens hydrating liquid 210. Segment S has an interior surface I including at least one relief element 232. Representative relief elements 232*a*-232*g* are shown in FIG. 2A. Interior surface I is flat, exclusive of at least one relief element 232 and a bulge BU adjacent perimeter P, resulting from the leak detection process (described below). That is, as shown in FIG. 2A, interior surface I, exclusive of the at least one relief element 232 and bulge BU caused by the leak detection process, is a substantially uniform distance from the bottom B of cavity C (as measured perpendicular to the flat portion of surface I) to a plane that is tangent to bottom B of the blister packaging.

Lid stock 230 can be made of any conventional lid stock material for use with contact lenses that is capable of having relief elements formed therein for example conventional multilayer packaging foil. Such a multilayer foil typically has at least one layer of flexible metal (e.g., aluminum) and at least one layer of plastic resin. The innermost layer is typically plastic. Lens hydrating liquid 210 may be any conventional lens hydrating liquid (e.g., saline or purified water). Blister packaging 220 may be made of any conventional blister packing for use with contact lenses. For example, the blister packaging may be made of polypropylene, polyethylene, polyvinylchloride, or polystyrene.

An air gap 240 is disposed between a top surface TS of lens hydrating liquid 210 and at least a portion of the interior surface. Typically, the lens hydrating liquid fills at most 99% of the volume of the cavity. In some embodiments, the lens hydrating liquid fills at most 98% of the volume of the cavity; in some embodiments, the lens hydrating liquid fills at most 95% of the volume of the cavity; and in some embodiments, the lens hydrating liquid fills at most 90% of the volume of the cavity It will be appreciated that the shape of the air gap may be influenced at least by water tension and cohesion with foil and blister packaging; in some embodiments, the air gap may manifest as an air bubble. As indicated above, the presence of an air gap provides several quality-related benefits.

The presence of an at least one relief element on the interior surface of the lid stock prevents the lens from adhering to the lid stock; however, by having the interior surface I (exclusive of at least one relief element 132) configured to be flat, it is possible to enhance the resistance of the lens adhering to the interior surface of the lid stock, for example, because the lens is less likely to conform to a flat shape. Additionally, as set forth above, due to less lens adherence resulting from having the interior surface I (exclusive of at least one relief element 132) configured to be flat, it is possible to provide less hydrating liquid within the lens packaging, thereby reducing the incidence of quality issues and machinery-related issues associated with lens hydrating liquid exiting the packaging during the packaging process.

Figure 3A:
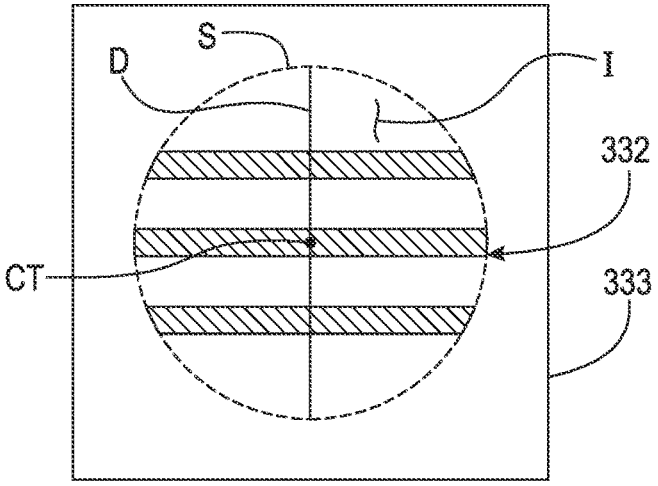
FIGS. 3A-3B are plan and side view, schematic illustrations of examples of relief element structures according to aspects of the invention formed on a lid stock that, excluding the relief element structures, is flat.
Figure 3B:
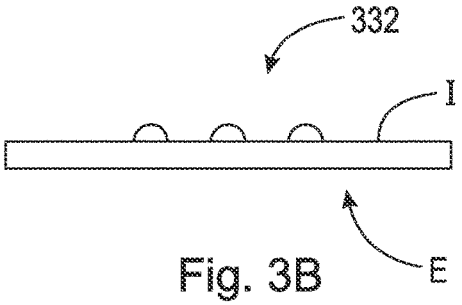

In some instances, as shown in FIGS. 3A and 3B, an at least one relief element 332 comprises a repeating pattern of cylindrically shaped relief elements across segment S and interior surface I of segment S, exclusive of at least one relief element 332, is flat. It is typically desirable that the at least one relief element 332 is sized and shaped relative to the size of segment S and the circumference of a packaged lens such the at least one relief element does not allow continuous contact between the lid stock and the circumference of the packaged lens. In FIGS. 3A and 3B it is apparent that the at least one relief element forms a periodic structure along a line D extending through center CT of segment S. In other embodiments comprising a plurality of relief elements, there is no line D extending through center CT along which a repeating structure is present.

Figure 3C:
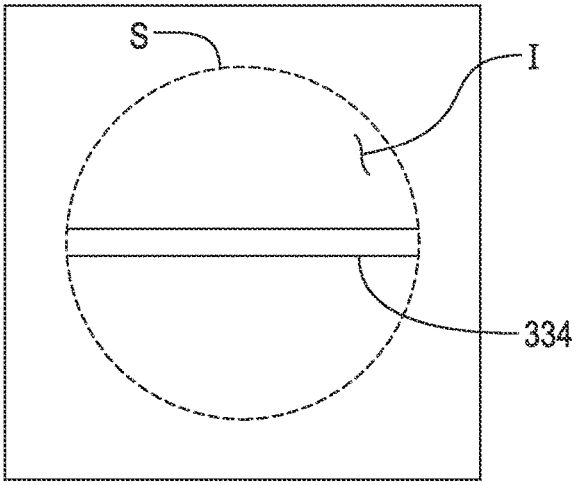
FIGS. 3C-3D are plan and side view, schematic illustrations of examples of relief element structures according to aspects of the invention formed on a lid stock that, excluding the relief element structures, is flat.
Figure 3D:
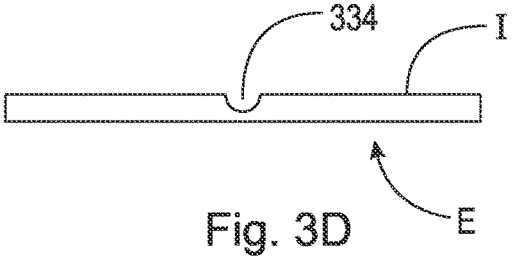

In other instances, as shown in FIGS. 3C and 3D, an at least one relief element consists of a single notch-shaped relief element 334 extending across the diameter of segment S, and interior surface I of segment S, exclusive of at least one relief element 334, is flat. It is typically desirable that a single relief element (e.g., relief element 334) spanning segment S extend through a center point or proximate a center point of segment S such that the relative sizes of segment S and the circumference of a packaged lens do not allow continuous contact between the lid stock and the circumference of the lens.

Figure 3E:
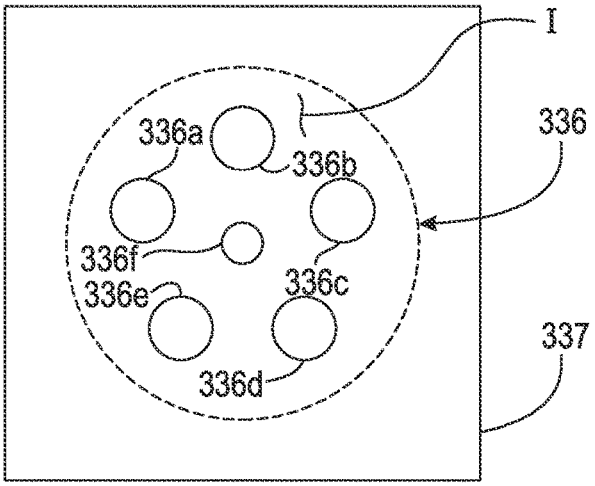
FIGS. 3E-3F are plan and side view, schematic illustrations of examples of relief element structures according to aspects of the invention formed on a lid stock that, excluding the relief element structures, is flat.
Figure 3F:
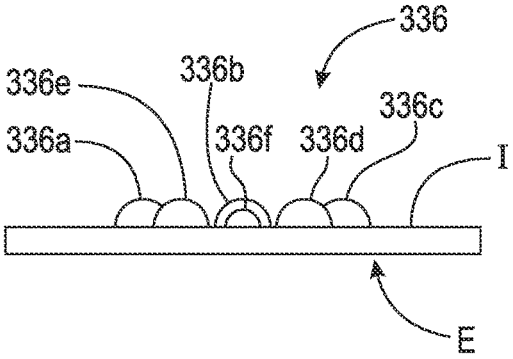

In still other instances, as shown in FIGS. 3E and 3F, the at least one relief element 336*a*-336*f* (collectively 336) does not comprise a repeating structure pattern and interior surface I of a lid stock 337, exclusive of at least one relief element 336, is flat. Non-repeating structure 336 comprises five spherical or spheroid protuberances 336*a*-336*e* formed in a circle and one spherical protuberance 336*f* in the middle of the circle. Although FIGS. 3E and 3F show spherical relief elements other dome-shaped protuberances may be used.

It will be appreciated that a discontinuity where the dome-shaped surface meets a flat sheet and the change in height along a relief element serve to reduce the likelihood or prohibit suction-cupping of the lens to the lid stock. An additional benefit of a dome-shaped relieve element over other shapes is that the formation of a surface having a continuous curvature rather than a surface having a discontinuity within the relief element is less likely to damage the lid stock as a result of pressure imparted during formation of the relief element.

Although the examples of relief element shown in FIGS. 3A-3F have features on a scale large enough to visible to an unaided eye, it is to be appreciated that an at least one relief element may be on a scale so as not to be visible to an unaided eye.

For example, for use with a typical silicone hydrogel (e.g., kalifilicon A), spherically-shaped relief elements having a radius of curvature of about 4-6 mm and a diameter of about 4-6 mm may be used. In some instances, the relief elements have an overall height (relative to the flat portions of the foil) of about 0.25-0.5 mm. Relief elements having different curvatures than one another and/or diameters can be used on a given foil. In some embodiments, it is advantageous that the relief elements share a common tangent plane at their apices.

For the purpose of preventing suction-cupping, a lid stock is to have an interior surface with relief elements formed thereon; however, an exterior surface E of the lid stock may have contouring corresponding to the relief elements or may not. In some instance it is preferable that an exterior surface have no corresponding contouring such that the exterior surface is flat. A flat exterior surface may, for example, facilitate printing on the exterior surface.

Relief elements can be formed in any suitable manner, for example, using an embossing technique by pressing a stamp (also referred to as a die) having a contour corresponding to the relief structure to be formed on the lid stock, or using additive or subtractive manufacturing techniques.

An embossing procedure to impart the at least one relief element on a lid stock can occur at any point in time prior to or after heat sealing; however, it is typically advantageous that a relief pattern be formed at a time distinct from formation of the heat seal to avoid affecting the integrity of the heat seal. Additionally, in some instances, it is advantageous that a step of forming an at least one relief element be combined with another step (i.e., combined with a step performed at a processing station described above) to allow for efficiency of time and energy.

In some embodiments, a stamp used for leak testing is machined to have a desired relief pattern formed thereon, such that, as pressure is applied to the lid stock by the stamp to test for leaking (i.e., leaks of air or hydrating liquid), the relief pattern is formed on the lid stock. The stamp along its bottom face is flat other than portions forming the relief elements. The diameter of the bottom face is, typically, approximately equal to (but less than) the diameter of the blister packaging cavity. Portions of the bottom of the stamp that are adjacent to and radially outward of the bottom face may have a rounded bevel. When pressure is applied to the lid stock, the beveled portion may give rise to a contour in the lid stock at locations that are adjacent to the heat seal (e.g., see a bulge BU as shown in FIG. 2A). Another technique for forming a relief structure employs a cylindrical roller; when using a roller, a contour corresponding to the relief structure is formed on the roller and the roller is rolled along the interior or exterior of the lid stock to form the relief structure in the lid stock. It will be understood that if the relief structure is to be formed by applying force on the interior of a lid stock, the pattern on the roller will be the negative of the pattern to formed on the interior surface of the lid stock.

Regardless of the technique used for applying the relief pattern, the objective is to apply a force to the packaging foil that is above the yield strength of the foil so that the pattern is maintained in the packaging foil after the force is applied, but below the point of causing failure at any locations along the foil thereby avoiding the formation of holes in any layers of the foil. As indicated above, a pattern having dome-shaped elements facilitates avoidance of failure during formation of the relief elements.

Although various embodiments have been depicted and described in detail herein, it will be apparent to those skilled in the relevant art that various modifications, additions, substitutions, and the like can be made without departing from the spirit of the invention and these are therefore considered to be within the scope of the invention as defined in the claims which follow.

What is claimed:

1. A contact lens package, comprising:

blister packaging defining a cavity;

a contact lens disposed in an unstressed state within the cavity;

lens hydrating liquid partially filling the cavity;

lid stock sealed to the blister packaging such that a segment of the lid stock in combination with the cavity forms an enclosure of the lens and the lens hydrating liquid, the segment having an interior surface including at least one relief element, the interior surface exclusive of the at least one relief element being flat; and an air gap disposed between a top surface of the lens hydrating liquid and at least a portion of the interior surface.

2. The package of claim 1, wherein the lens hydrating liquid fills at most 99% of the volume of the cavity.

3. The package of claim 1, wherein the lens hydrating liquid fills at most 98% of the volume of the cavity.

4. The package of claim 1, wherein the lens hydrating liquid fills at most 95% of the volume of the cavity.

5. The package of claim 1, wherein the lens hydrating liquid fills at most 90% of the volume of the cavity.

6. The package of claim 1, wherein the at least one relief element comprises a periodic structure.

7. The package of claim 6, wherein the structure is periodic along a line extending through a center of the segment.

8. The package of claim 1, wherein the at least one relief element comprises a non-periodic structure along all lines extending along flat portions of the lid stock and that extend through a center of the segment.

9. The package of claim 1, wherein the at least one relief element consists of a single relief element.

10. The package of claim 1, wherein an external surface of the lid stock is flat.

11. The package of claim 1, wherein the lid stock comprises an innermost layer that is plastic resin.

12. A contact lens package, comprising:

blister packaging defining a cavity;

a contact lens disposed in an unstressed state within the cavity;

lens hydrating liquid partially filling the cavity;

lid stock sealed to the blister packaging such that a segment of the lid stock in combination with the cavity forms an enclosure of the lens and the lens hydrating liquid, the segment having an interior surface including at least one dome-shaped relief element, the interior surface exclusive of the at least one relief element being flat.

13. The package of claim 12, wherein the lens hydrating liquid fills at most 99% of the volume of the cavity.

14. The package of claim 12, wherein the lens hydrating liquid fills at most 95% of the volume of the cavity.

15. The package of claim 12, wherein the at least one relief element comprises a periodic structure.

16. The package of claim 15, wherein the structure is periodic along a line extending through a center of the segment.

17. The package of claim 12, wherein the at least one relief element comprises a non-periodic structure along all lines extending along flat portions of the lid stock and that extend through a center of the segment.

18. A method of manufacturing a contact lens package, comprising:

producing a structure comprising blister packaging defining a cavity, a contact lens disposed in the cavity, lens hydrating liquid partially filling the cavity, and lid stock sealed to the blister packaging such that a segment of the lid stock in combination with the cavity forms an enclosure of the lens and the lens hydrating liquid; and testing the structure for leaks by applying pressure to the lid stock with a stamp having a contour corresponding to at least one relief element, whereby the pressure forms the at least one relief element on an interior surface of the lid stock.

* * * * *